US007874511B2

(12) United States Patent
Chiorgno et al.

(10) Patent No.: US 7,874,511 B2
(45) Date of Patent: Jan. 25, 2011

(54) BREAKDOWN REEL

(75) Inventors: David Chiorgno, Pittsfield, MA (US); Peter J. Olsta, Valatie, NY (US)

(73) Assignee: Pittsfield Plastics Engineering, Inc., Pittsfield, MA (US)

( * ) Notice: Subject to any disclaimer, the term of this patent is extended or adjusted under 35 U.S.C. 154(b) by 0 days.

(21) Appl. No.: 12/378,617

(22) Filed: Feb. 18, 2009

(65) Prior Publication Data

US 2009/0261195 A1 Oct. 22, 2009

Related U.S. Application Data

(63) Continuation-in-part of application No. 11/900,751, filed on Sep. 13, 2007, now Pat. No. 7,510,138.

(60) Provisional application No. 60/848,831, filed on Oct. 2, 2006.

(51) Int. Cl.
*B65H 75/18* (2006.01)

(52) U.S. Cl. ..... 242/608.2

(58) Field of Classification Search ..... 242/608, 242/608.2, 608.5, 608.6, 608.8, 607, 609.2
See application file for complete search history.

(56) References Cited

U.S. PATENT DOCUMENTS

| | | | | | |
|---|---|---|---|---|---|
| 2,154,343 | A * | 4/1939 | McDermott | ..... | 242/608.2 |
| 3,846,887 | A * | 11/1974 | Woods et al. | ..... | 242/608.6 |
| 4,002,310 | A * | 1/1977 | Ganser et al. | ..... | 242/608 |
| 4,371,123 | A * | 2/1983 | Watanabe | ..... | 242/610.6 |
| 5,335,873 | A * | 8/1994 | Harris et al. | ..... | 242/608.6 |
| 5,975,459 | A * | 11/1999 | Roman | ..... | 242/608.6 |
| 6,234,421 | B1 * | 5/2001 | Cox et al. | ..... | 242/608.8 |
| 6,398,154 | B1 * | 6/2002 | Cox et al. | ..... | 242/608.2 |
| 7,510,138 | B2 * | 3/2009 | Chiorgno et al. | ..... | 242/608.2 |
| 2003/0197087 | A9 * | 10/2003 | Cox et al. | ..... | 242/608.6 |

* cited by examiner

*Primary Examiner*—William A Rivera
(74) *Attorney, Agent, or Firm*—Robert L. Rispoli

(57) ABSTRACT

The present device provides a breakdown reel that includes a spool barrel, at least one flange and likely two, one disposed at each end of the barrel, and a locking mechanism such that the flange lockingly engages and removeably disengages the barrel. The locking mechanism is divided into two sections, one is conjoined with the barrel and the other is conjoined with the flange. The two sections of the locking mechanism provide the unique the locking and unlocking action.

8 Claims, 11 Drawing Sheets

Spring Slot Revision

FIG. 8
FIG. 8A
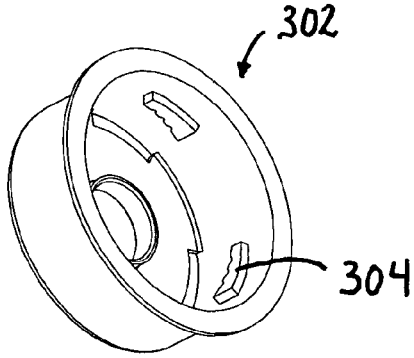
FIG. 8B
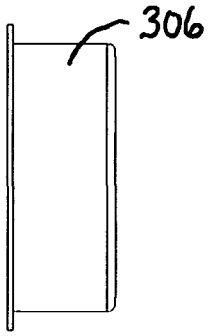
FIG. 8C
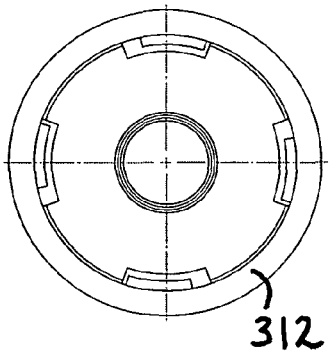
FIG. 8D
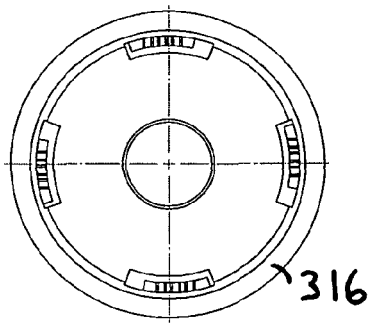

FIG. 9
FIG. 9A
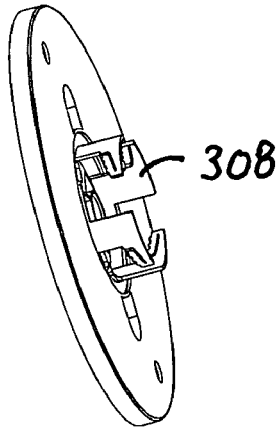
FIG. 9B
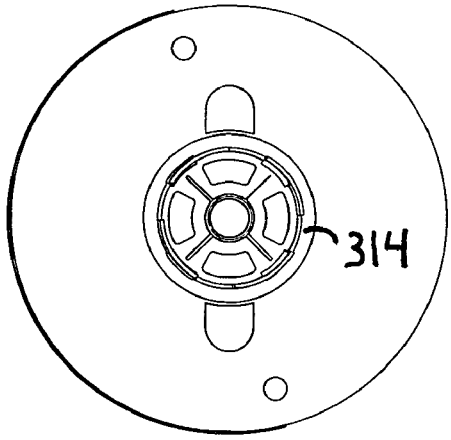
FIG. 9C
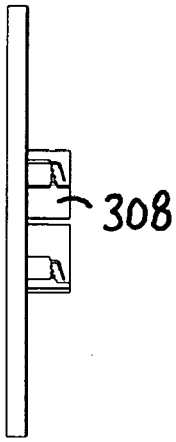
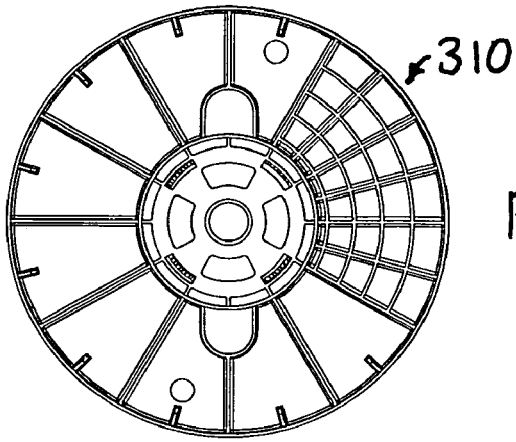
FIG. 9D FIG. 10
FIG. 10A
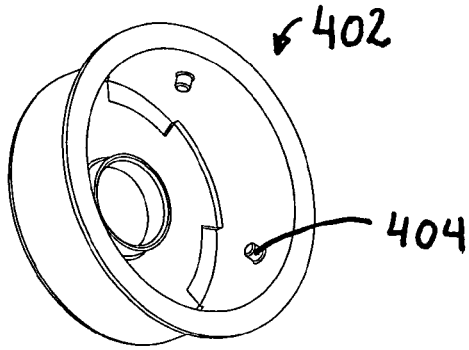
FIG. 10B
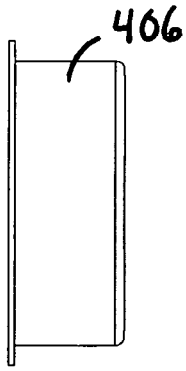
FIG. 10C
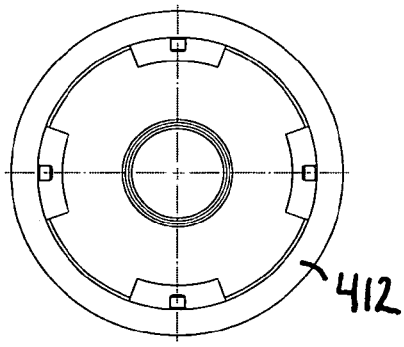
FIG. 10D
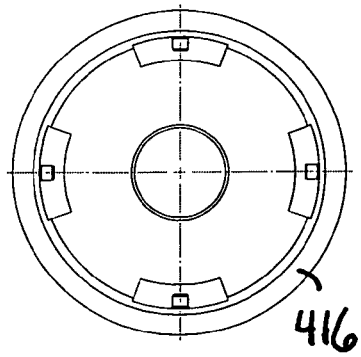

FIG. 11
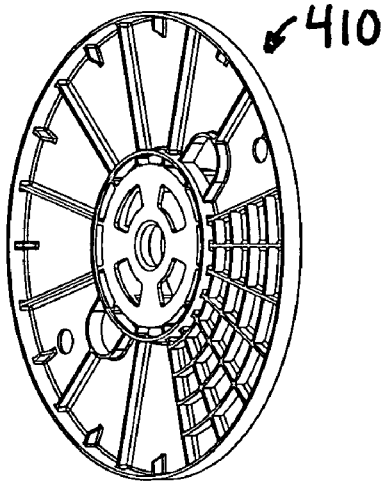
FIG. 11A
FIG. 11B
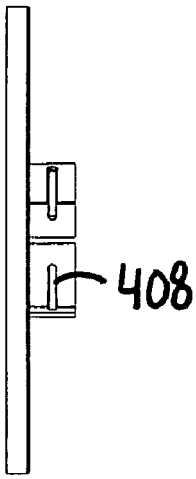
FIG. 11C
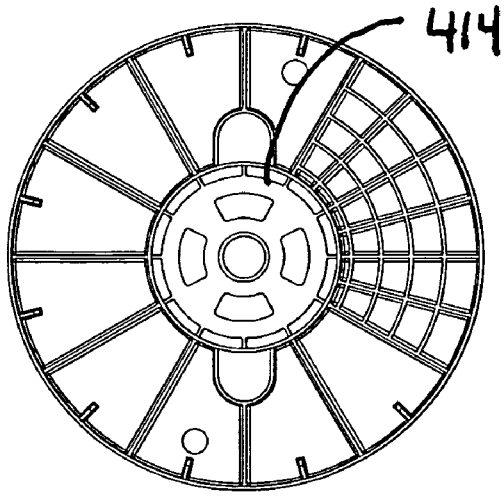

BREAKDOWN REEL

CROSS-REFERENCE TO RELATED APPLICATION

This application is a Continuation-in-Part of U.S. patent application Ser. No. 11/900,751; filed on Sep. 13, 2007 now U.S. Pat. No. 7,510,138; which in turn claimed the benefit of U.S. Provisional Application No. 60/848,831; filed Oct. 2, 2006.

BACKGROUND OF THE INVENTION

1. Field of the Invention

Spools or reels generally comprise a barrel and two opposing flanges. The present invention is directed to a spool on which continuous-strand products such as insulated or bare wire, cable, textile yarns, cordage, chain, etc. are wound. In particular, the invention is directed toward a spool that may be efficiently assembled and disassembled. Such spools are commonly referred to as "knockdown reels". More particularly, the present invention provides a mechanism for the assembly and disassembly of a knockdown reel in an efficient manner comprising a device for securely fastening and easily unfastening the flanges to the barrel.

2. Brief Description of the Related Art

There are a vast assortment of spools available in the prior art ranging from spools on which threads are wound to spools on which chains and cables are wound. The smaller spools upon which thread and the like are wound are typically fabricated in one-piece units that are disposable. In contrast, the larger spools must be more robust in order provide the necessary functionality required. Accordingly, these spools are constructed of more durable material and are more complex in design often comprising several components. Consequently, such spools typically are manufactured by one party and shipped to a second party that will wind a product around the spool. In order to economically and efficiently manufacture the necessary robust spool while minimizing shipping costs, manufacturers have endeavored to create innovative spool assembly and disassembly methods.

Some prior art methods and devices for knockdown reels are known. These devices appear to have the advantage of disassembly for compact storage. However, most reels or spools disclosed in these references have significant differences from the present invention. Typically, knockdown reels comprise a barrel, two opposing flanges, and some sort of connecting mechanism engaging the flanges and the barrel.

For example, U.S. Pat. No. 6,045,087 to Vislocky and Curtis discloses a spool assembly having a barrel with flanges that engagingly snap fit thereon. The barrel (spindle) 10, defines guiding notches 15 and 16 and locking openings 13 and 14 disposed on opposing end faces. The flanges 110 and 210 in turn define guiding members 116 and 216 to engage guiding notches 15 and 16. Hubs 112 and 212 are fixedly attached to flanges 110 and 210 and define locking members 114 and 214 to engage locking openings 13 and 14. (See Vislocky and Curtis, Abstract, Column 1, lines 35-48, Column 6, lines 25-49, and related Figures).

In another example, U.S. Pat. No. 5,743,486 to Bulman discloses a knockdown reel comprised of a barrel (core) 11 having threaded ends 15 and end flanges 12 threadedly attached to the threaded ends 15. Extending outward from threaded ends 15 of barrel 11 is a tapered locking ring 14. Locking ring 14 is designed to engage locking ring 19 of flanges 12 when the flanges are fully threaded on to the barrel. (See Bulman, Column 2, lines 64-67 and related Figures). It would require a "very deliberate act" to disassemble the mechanism. (See Bulman, Column 3, line 37).

U.S. Pat. No. 5,143,316 to Goetz, Charles R. and Goetz, Charles G. describes yet another prior art knockdown reel that defines a barrel (spindle) 5, flanges (end plates) 2, and hubs 3 "formed integrally with each end plate". (See Goetz, Column 2, line 66). Hub 3 receives a respective end portion of barrel 5. Goetz further discloses a slide 32 that moves axially relative to the barrel and provides a subassembly that accommodates a mandrel for rotating the spool. When the slide is in a recessed position, it is located within the spool. (See Goetz, Column 3, line 59 to Column 4, line 7).

In another prior art example, U.S. Pat. No. 4,903,913 to McCaffrey discloses a knock-down spool assembly including a barrel (spindle) 50 and end plates 11 and 21 comprising flanges 12 and 22 and integrally formed hubs 16 and 26. (See McCaffrey, Column 3, lines 13-21 and lines 43-45). End portions 51 and 52 of barrel 50 define integrally formed projections 55 and 56 designed to engage openings 40*a* and 40*b* in plates 11 and 21. (See McCaffrey, Column 4, lines 28-34).

U.S. Pat. No. 3,822,841 to Campbell discloses one of the more typical knockdown reels known. The reel comprises a barrel (hub) 12 and flanges 14. The flanges define sockets 32 that serve as a hub for receiving the barrel. The ends of barrel 12 define latch members 24 each having locking abutments 28 defined thereon. Locking abutments 28 engage apertures 40 of the side wall 34 of socket 32. (See Campbell, FIG. 12, Column 5, lines 1-9 and lines 59-66).

U.S. Pat. No. 3,552,677 to Hacker also describes a basic knockdown reel comprising a barrel (drum) 10, flanges 30 and 50, hub (collar) 38 formed within bore 42 of a flange, and locking means 50. A socket 46 is formed in the outer ends of barrel 10 and the socket forms sleeve 48. Stems 52 extend outwardly from edge 54 of sleeve 48 and are received in corresponding apertures 56 in the flange. Stems 52 define catches 58 to engage shoulders 62 formed on the hub 38. (See Hacker, Column 3, lines 31-33, and Column 3, line 58-Column 4, line 9).

Most of the prior art devices known have been designed for easy assembly but not necessarily easy and quick disassembly. As one practiced in the art knows, the prior art devices that comprises locking tabs that engage corresponding openings do not provide a robust disassembly method. Often times the tabs break rendering the entire spool use less if the tabs are integrally formed with either the hub or the barrel as is the case with most of the prior art devices. In certain applications, the method of employing simple tabs or protrusions that engage corresponding openings will not provide a suitable durable assembled spool either.

In other prior art devices wherein the hub is integrally formed with the disk, more space is required for storage or shipping such spool components than if the hub was formed as a separate component. Other prior art devices, such as those wherein the hub threadedly engages the flanges and then engages a locking mechanism, require too much time and effort to disassemble and often are discarded after use. In addition, these prior art devices generally comprise hubs integrally formed with the disk Based on the foregoing, a need exists for a spool or knockdown reel comprising two flanges and a barrel disposed therebetween that may be efficiently assembled and disassembled. When such a reel is assembled, continuous-strand products such as insulated or bare wire, cable, textile yarns, cordage, chain, etc. are wound around the barrel between the two flanges. Most prior art reels have to be shipped in an assembled position in order to exhibit their desired characteristics such as strength, resistance to wear and fatigue, etc. On the other hand, prior art knockdown spools that can be shipped non-assembled and advantageously provide lower-cost shipping, handling and storage characteristics do not provide the desired strength, resistance to wear and fatigue, etc. characteristics and also require time-consuming assembly on the part of the receiver of the unassembled reels.

It is an object of the present invention to overcome the shortcomings of the prior art stated above. It is another object of the present invention to provide a mechanism for the assembly and disassembly of a knockdown reel in an efficient manner. It is another object of the present invention to provide a device for securely fastening and easily unfastening the flanges to the barrel of a knockdown reel.

DESCRIPTION OF THE INVENTION

The knockdown reel of the present invention comprises a barrel, two opposing flanges, a hub that accommodates the secure fastening and easily unfastening of the flanges to the barrel. The hub, referred to herein as a locking mechanism, is fabricated comprises two components, an inner section and an outer section. The inner section of the locking mechanism is fixedly or removeably attached to an end of the barrel as further described herein. The outer section of the locking mechanism is designed such that it comprises the device for securely fastening and easily unfastening the flanges to the barrel of a knockdown reel.

BRIEF DESCRIPTION OF THE DRAWINGS

FIGS. 8 and 9 provide a three-dimensional rendering of another embodiment of a locking mechanism according to the present invention.

FIGS. 10 and 11 provide a three-dimensional rendering of another embodiment of a locking mechanism according to the present invention.

DETAILED DESCRIPTION OF THE INVENTION

Figure 1:
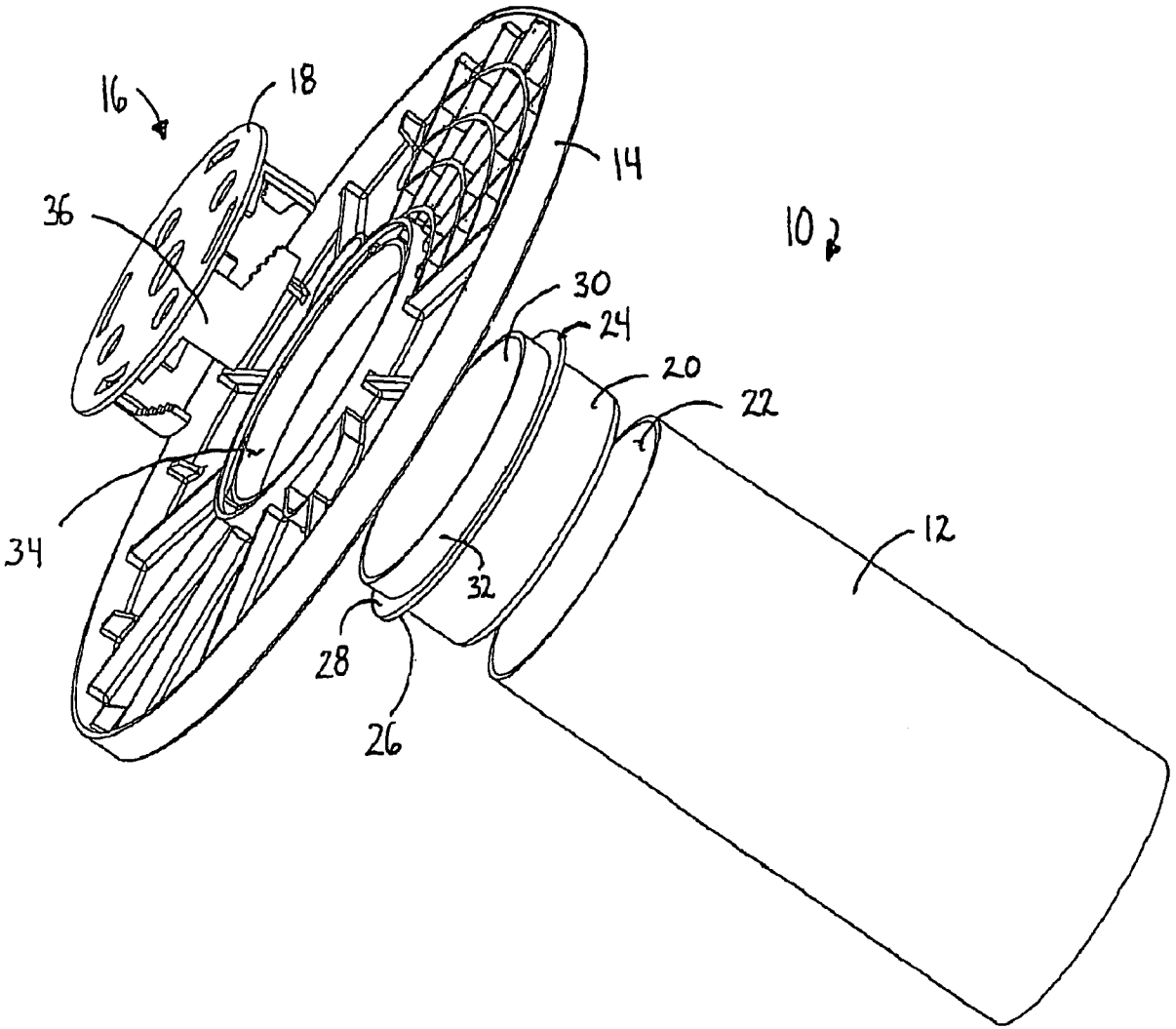
FIG. 1 provides a three-dimensional rendering of a disassembled knockdown reel according to the present invention.
Figure 2:
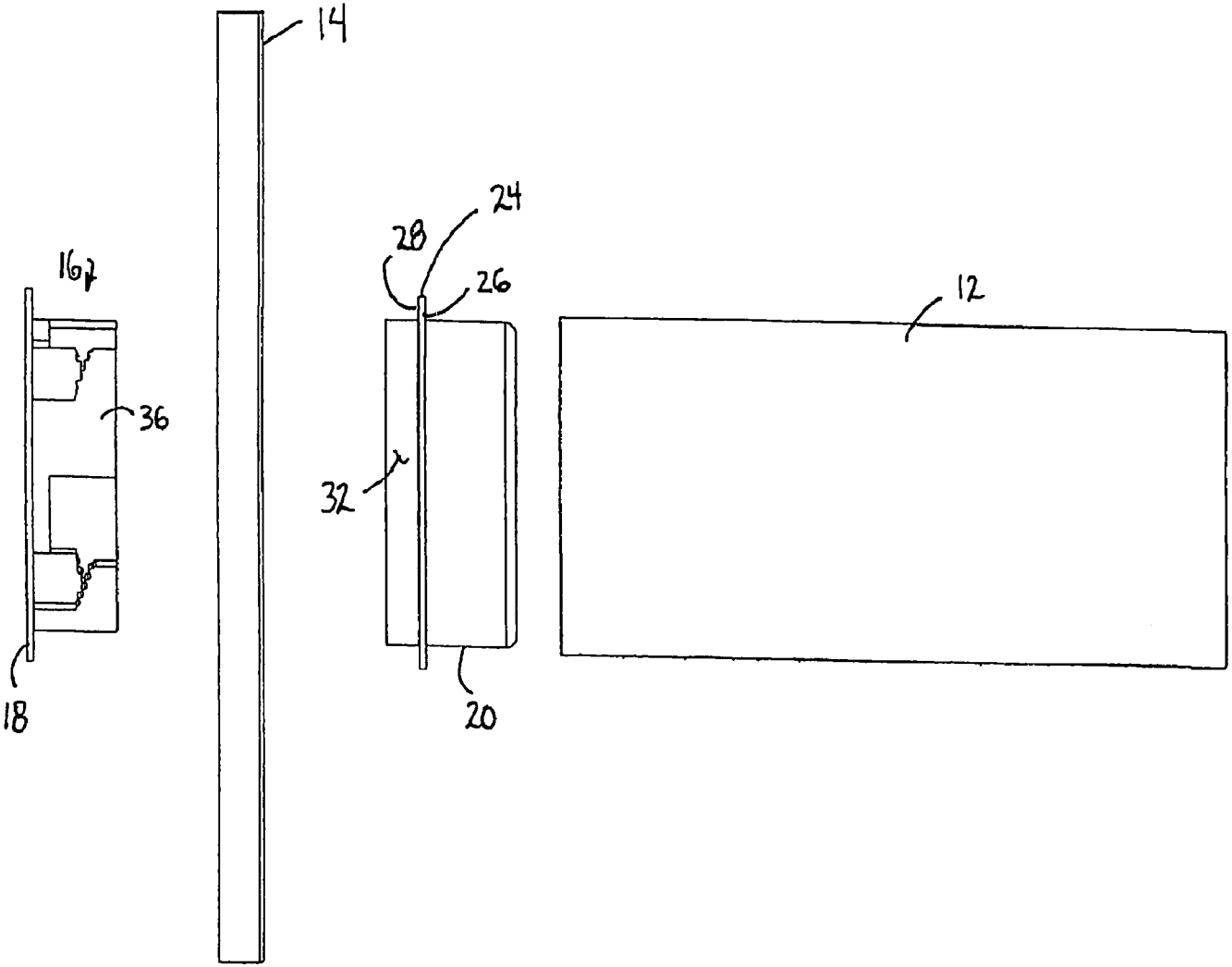
FIG. 2 depicts a schematic representation of a disassembled knockdown reel according to the present invention.

One embodiment of the device, as shown in FIGS. 1 and 2, comprises a spool 10 further comprising a barrel 12 and at least one flange 14. The locking mechanism 16 comprises two components: an outside section 18 and an inside section 20. The inside section 20 is fabricated to interlock or be conjoined with the barrel 12 on one end 22. In one embodiment, the outer diameter of inside section 20 and the inner diameter of barrel 12 are conjoined via solvent welding. In another embodiment, the outer diameter of inside section 20 engages the inner diameter of barrel 12 via protruding barbs. In yet another embodiment, the outer diameter of inside section 20 threadedly engages the inner diameter of barrel 12. There are many known methods for removeably or fixedly securing inside section 20 to barrel 12 on one end 22, each of which are considered within the scope of this invention.

As further shown in FIG. 1, inside section 20 exhibits a radial flange 24 which, in turn, defines an inner face 26 and an outer face 28. Face 26 is disposed toward barrel 12 and may serve to define connectivity with barrel 12. Face 28 is disposed toward flange 14 and may serve to define connectivity with flange 14. Inside section 20 further defines an inner diameter face 30 and an outer diameter face 32. Flange 14 further defines an inner diameter face 34. In this embodiment of the invention, flange 14 is brought into contact with and positioned or seated on inside section 20 radial flange 24 face 28. Flange inner diameter face 34 is brought into contact with and positioned proximate to outer diameter face 32 of inside section 20.

The novelty of the embodiment shown in FIG. 1 arises with the connectivity of outside section 18 with inside section 20, both of locking mechanism 16, thereby removeably securing flange 14 to barrel 12.

Outside section 18 defines keyed elements 36 fabricated to mate with opposing elements (not shown) fabricated in inner diameter face 30 of inside section 20. Such elements provide for a secured latching mechanism assuring the connectivity of the mating pieces. The loading of the spool further assures connectivity of the pieces by applying loading such that the locking mechanism is retained in its locked position. Correspondingly, the latching mechanism permits a simple detaching of the pieces by an application of force in the opposite direction.

Figure 3:
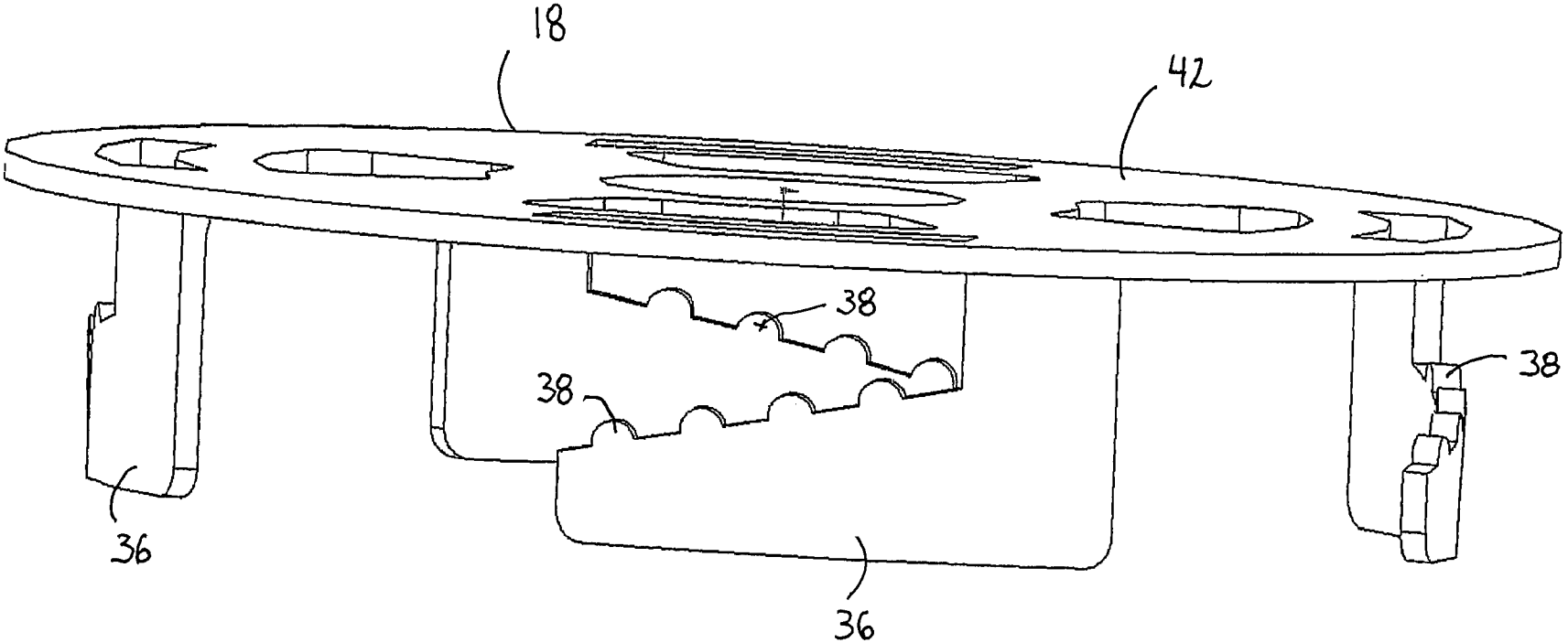
FIG. 3 provides a three-dimensional rendering of a component of the locking mechanism according to the present invention.
Figure 4A:
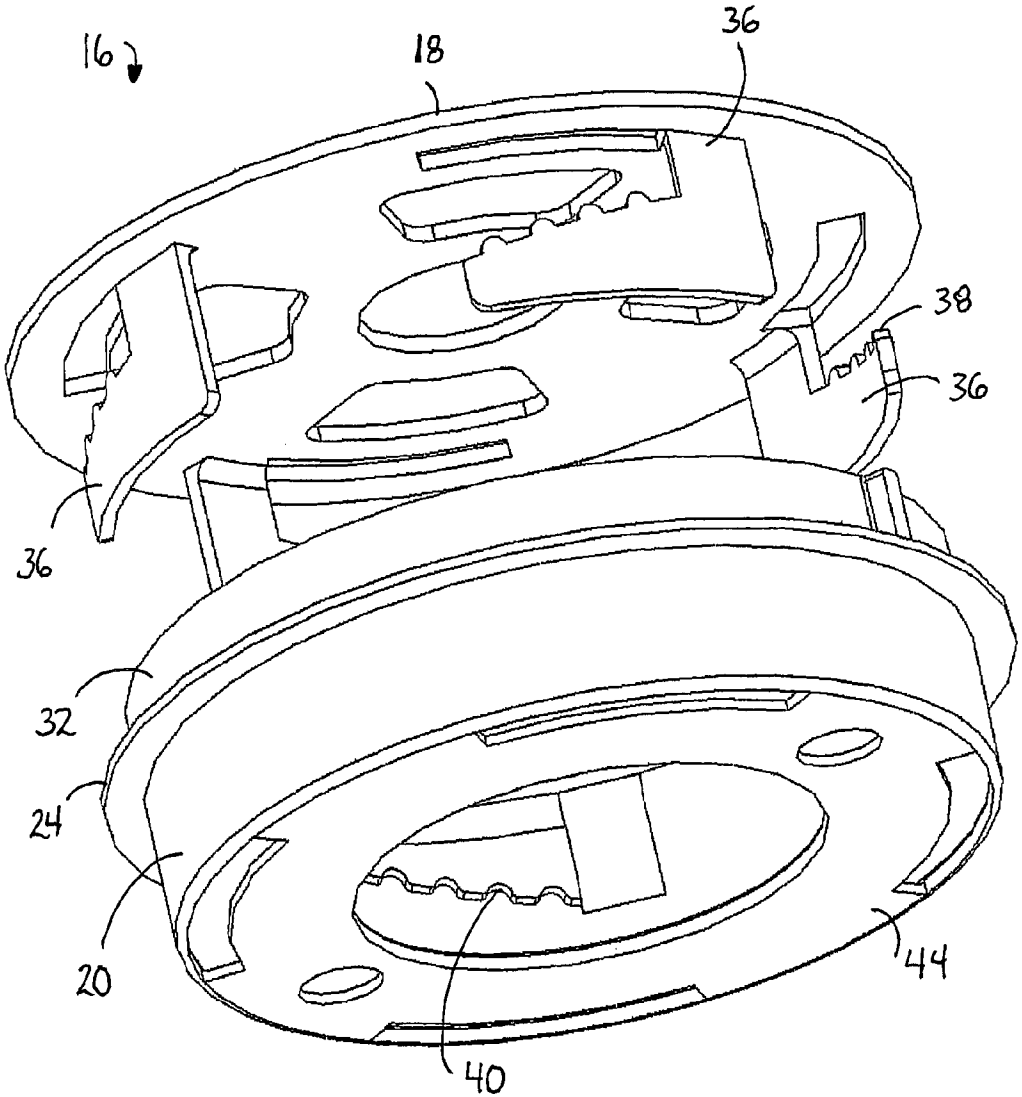
FIGS. 4A and 4B provide a three-dimensional rendering of a locking mechanism according to the present invention.
Figure 4B:
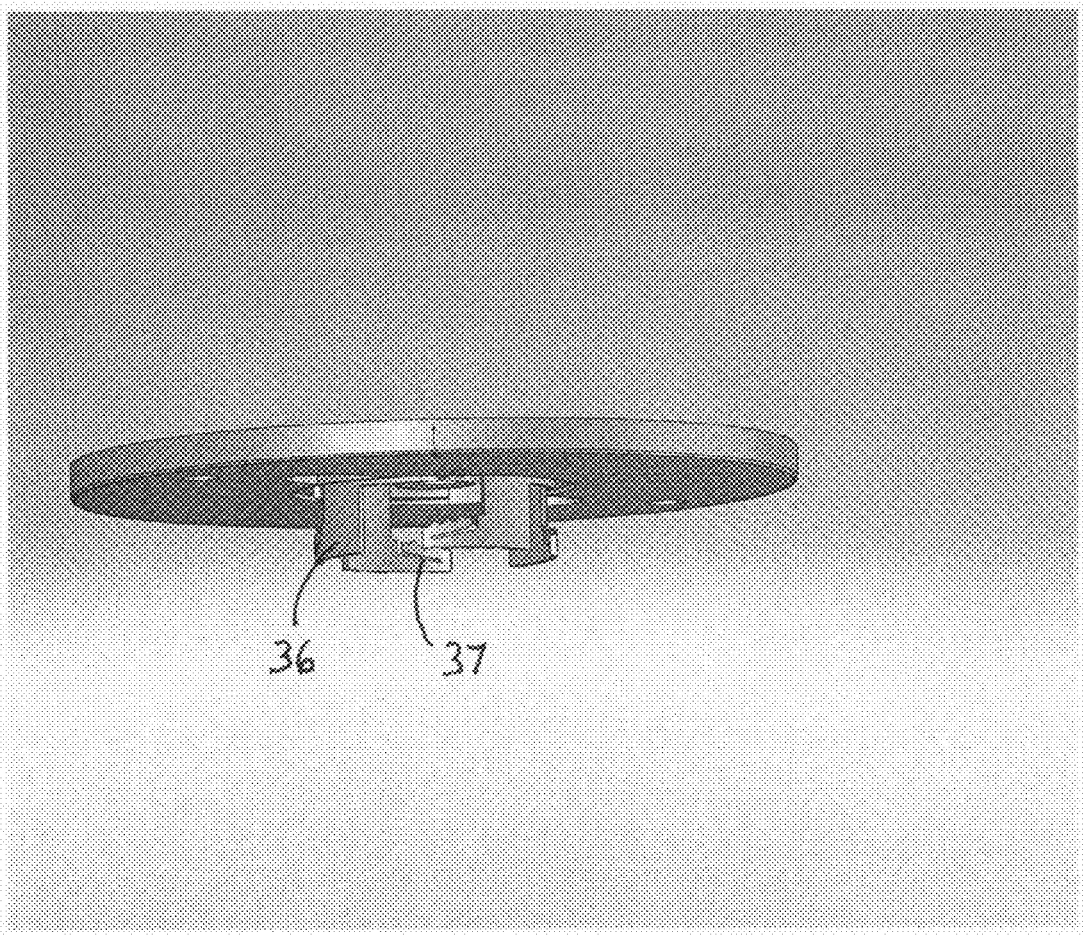

The embodiment of outside section 18 described above with respect to FIG. 1 can best be viewed in FIG. 3. Keyed elements 36 exhibit click-locking protrusions 38 designed to engage click-locking receptacles 40 of inner section 20 shown in FIG. 4A. As shown in FIG. 4B, keyed elements 36 may further define spring slots 37 to enhance the click-locking engagement of receptacles 40.

Figure 5:
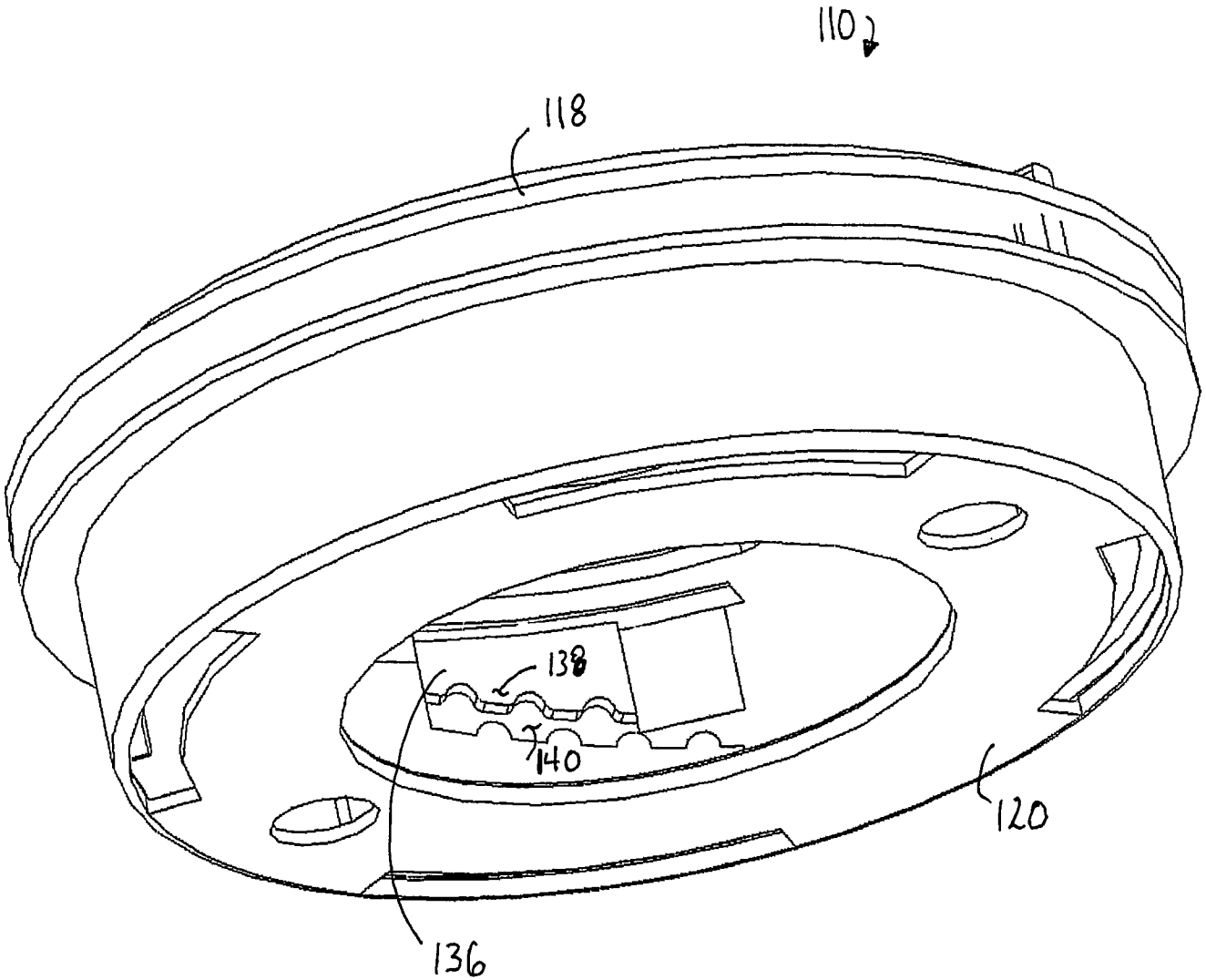
FIG. 5 provides a three-dimensional rendering of another embodiment of a locking mechanism according to the present invention.

As shown in FIG. 5, outside section 118 exhibits keyed elements 136 which, in turn, define click-locking protrusions 138 designed to engage click-locking receptacles 140 of inner section 120.

Figure 7:
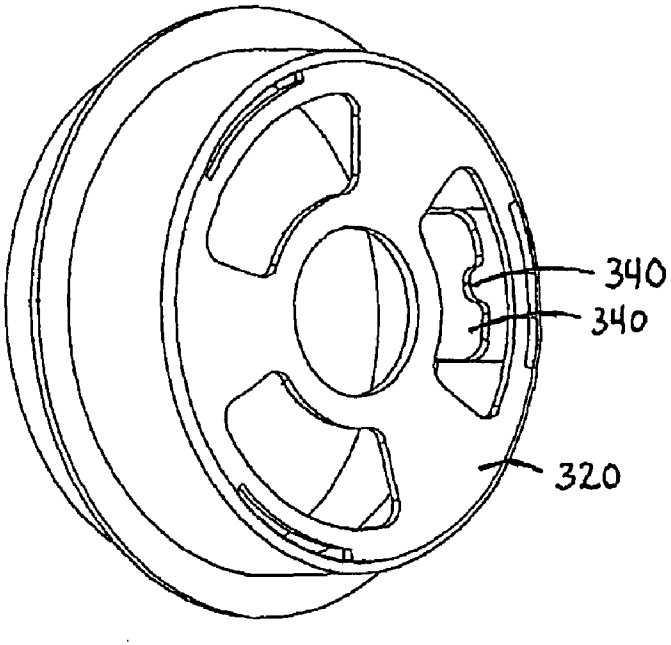
FIG. 7 provides a three-dimensional rendering of another embodiment of a locking mechanism according to the present invention.
Figure 6:
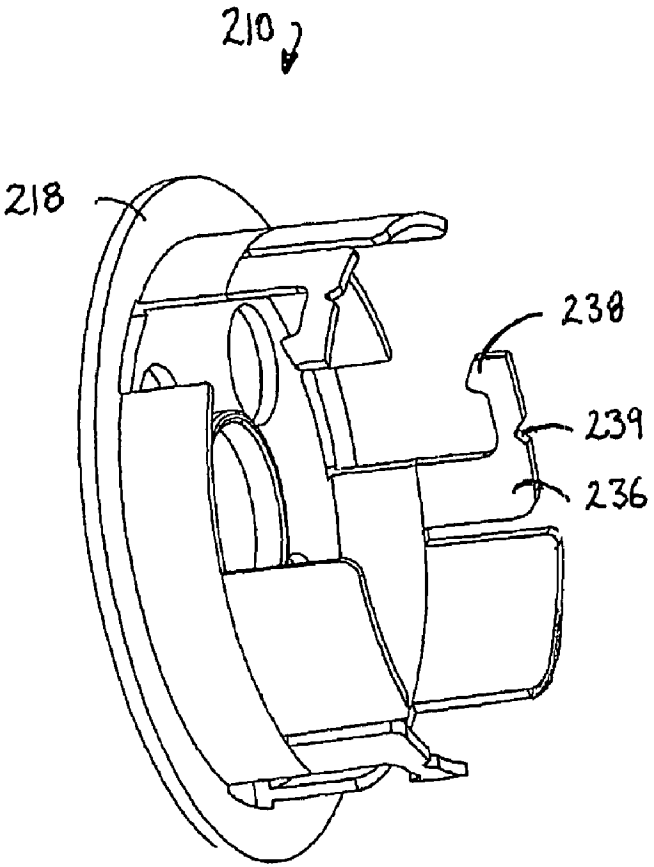
FIG. 6 provides a three-dimensional rendering of another embodiment of a locking mechanism according to the present invention.

FIGS. 6 and 7 provide diagrammatic representations of yet additional embodiments of the locking arrangement of the present invention. As shown in FIG. 6, outside section 218 defines keyed elements 236 which, in turn, defines protrusions 238 and receptacle 239. The inner diameter of inner section 220 (not shown) would be fabricated to correspond with keyed element 236. As shown in FIG. 7, the inner diameter of an alternative embodiment of inner section 320 can form a variety of configurations 340 to correspond with a keyed element of the outer section of the locking mechanism.

The apertures shown in the top face 42 of outer section 18 and bottom face 44 of inner section 20, FIG. 3 and FIG. 4, respectively, are for manufacturing, molding and utility purposes as well as for users of the goods in commerce. The method of manufacturing locking mechanism 16 wherein the protrusions 38 and receptacles 40 can be integrally formed with outer section 18 and inner section 20, receptively, is considered within the scope of this invention. The components can be injection molded to include their respective protrusions and receptacles, or injection molded and then stamped. There are many known methods for fabricating protrusions and receptacles as disclosed above such as the use of pins, male-female receptacles, etc., each of which are considered within the scope of this invention.

FIGS. 8 and 9 provide a diagrammatic representation of yet another embodiment of the locking arrangement of the present invention. As shown in FIG. 8A, a section or flange hub 302 defines keyed elements 304. The outer diameter 306 of flange hub 302 shown in FIG. 8B is fabricated to correspond with keyed elements 308 shown in FIGS. 9A and 9C incorporated into prefabricated flange 310 shown in FIG. 9D. Surface 312 of flange hub 302 shown in FIG. 8C is designed to engage a corresponding trough 314 shown in FIG. 9B. Surface 316 of flange hub 302 shown in FIG. 8D is designed to engage a corresponding prefabricated surface of a spool barrel.

FIGS. 10 and 11 provide a diagrammatic representation of yet another embodiment of the locking arrangement of the present invention. As shown in FIG. 10A, a section or flange hub 402 defines protrusions 404. The outer diameter 406 of flange hub 402 shown in FIG. 10B is fabricated to correspond with grooves 408 shown in FIG. 11B incorporated into prefabricated flange 410 shown in FIG. 11A. Surface 412 of flange hub 402 shown in FIG. 10C is designed to engage a corresponding face 414 shown in FIG. 11C. Surface 416 of flange hub 402 shown in FIG. 10D is designed to engage a corresponding prefabricated surface of a spool barrel.

The knockdown reel of the present invention overcomes the shortcomings of the prior art by providing a novel mechanism for the assembly and disassembly of a knockdown reel in an efficient manner. In addition, the present invention provides a device for securely and more robustly fastening and easily unfastening the flanges to the barrel of a knockdown reel. Although the invention has been described in considerable detail with respect to particular embodiments of Applicant's locking mechanism for knockdown reels, it will be apparent that the invention is capable of numerous modifications and variations, apparent to those skilled in the art, without departing from the spirit and scope of the invention.

The invention claimed is:

1. A breakdown reel comprising:

a) a spool barrel;

b) at least one flange;

c) a locking mechanism comprised of an inside section and an outside second section wherein the inside section is conjoined with the barrel and the outside section is conjoined with the flange;

d) the inside section lockingly engages and removeably disengages the outside section;

e) the inside section of the locking mechanism and the outside section of the locking mechanism each define at least one keyed element whereby the keyed element of the inside section lockingly engages and removeably disengages the keyed element of the outside section; and f) at least one of the keyed elements further define a spring slot to enhance engaging and removeably disengaging the other keyed element.

2. The breakdown reel of claim 1 wherein the outer section defines the keyed element defining the spring slot.

3. The breakdown reel of claim 1 wherein the inner section defines the keyed element defining the spring slot.

4. The breakdown reel of claim 1 wherein a plurality of keyed elements each define a spring slot.

5. A breakdown reel comprising:

a) a spool barrel;

b) a flange hub;

c) at least one flange wherein the flange defines a prefabricated locking mechanism conjoined with the flange and the locking mechanism lockingly engages and removeably disengages the flange hub;

d) a flange hub locking mechanism defining at least one keyed element;

e) a flange prefabricated locking mechanism defining at least one keyed element;

f) at least one keyed element defines a spring slot; and g) at least one keyed element of the hub locking mechanism lockingly engages and removeably disengages at least one keyed element of the flange prefabricated locking mechanism.

6. The breakdown reel of claim 5 wherein a plurality of keyed elements each define a spring slot.

7. A breakdown reel comprising:

a) a spool barrel;

b) a flange hub;

c) a flange hub locking mechanism defining at least one protrusion;

d) at least one flange wherein the flange defines a flange prefabricated locking mechanism defining at least one groove; and e) at least one protrusion of the flange hub locking mechanism lockingly engages and removeably disengages at least one groove of the flange prefabricated locking mechanism.

8. The breakdown reel of claim 7 wherein the flange hub defines a plurality of protrusions and the flange prefabricated locking mechanism defines a corresponding plurality of grooves.

* * * * *